US012742578B2

(12) United States Patent
Guo et al.

(10) Patent No.: US 12,742,578 B2
(45) Date of Patent: Sep. 22, 2026

(54) CONTROL METHOD, APPARATUS, AND DEVICE FOR COMPRESSOR, STORAGE MEDIUM, AND REFRIGERATION SYSTEM

(71) Applicants: GD MIDEA HEATING & VENTILATING EQUIPMENT CO., LTD., Foshan (CN); HEFEI MIDEA HEATING & VENTILATING EQUIPMENT CO., LTD., Hefei (CN)

(72) Inventors: Fangcheng Guo, Foshan (CN); Yunxiao Ding, Foshan (CN); Chunyuan Zheng, Foshan (CN); Bin Luo, Foshan (CN); Bao Yue, Foshan (CN)

(73) Assignees: GD MIDEA HEATING & VENTILATING EQUIPMENT CO., LTD., Foshan (CN); HEFEI MIDEA HEATING & VENTILATING EQUIPMENT CO., LTD., Hefei (CN)

( * ) Notice: Subject to any disclaimer, the term of this patent is extended or adjusted under 35 U.S.C. 154(b) by 330 days.

(21) Appl. No.: 18/548,496

(22) PCT Filed: Sep. 29, 2021

(86) PCT No.: PCT/CN2021/121837
§ 371 (c)(1),
(2) Date: Aug. 30, 2023

(87) PCT Pub. No.: WO2022/183725
PCT Pub. Date: Sep. 9, 2022

(65) Prior Publication Data

US 2024/0133606 A1 Apr. 25, 2024
US 2024/0230195 A9 Jul. 11, 2024

(30) Foreign Application Priority Data

Mar. 2, 2021 (CN) ..... 202110233333.9

(51) Int. Cl.
*F25B 49/02* (2006.01)

(52) U.S. Cl.
CPC ..... *F25B 49/022* (2013.01); *F25B 2500/19* (2013.01); *F25B 2700/2115* (2013.01)

(58) Field of Classification Search
CPC ..... F25B 49/022; F25B 2500/19; F25B 2700/2115
See application file for complete search history.

(56) References Cited

U.S. PATENT DOCUMENTS

2012/0177514 A1* 7/2012 Hahn ..... F25B 49/02 417/423.7
2019/0249894 A1 8/2019 Zhang
(Continued)

FOREIGN PATENT DOCUMENTS

CN 1573261 A 2/2005
CN 102588288 A 7/2012
(Continued)

OTHER PUBLICATIONS

FOR2, Control Method of Electronic Expansion Valve, Device and Electric Appliance, 2021, Full Document (Year: 2021).*
(Continued)

*Primary Examiner* — Nael N Babaa
(74) *Attorney, Agent, or Firm* — K&L Gates LLP

(57) ABSTRACT

The present disclosure provides a control method, apparatus, and device for a compressor, a storage medium, and a refrigerator system. The control method includes: obtaining an electrical parameter, a return air parameter, and a first frequency of the compressor during operation of the compressor; determining a first fitting formula corresponding to the first frequency; obtaining an exhaust pressure by inputting the electrical parameter and the return air parameter into the first fitting formula for calculation; and controlling the
(Continued)

compressor based on the exhaust pressure. In this way, the pressure sensor disposed on an exhaust side of an air conditioner can be omitted, hence cost is saved; or for the air conditioner with the pressure sensor on the exhaust side, the above manner for calculation can be an alternative to obtaining the exhaust pressure, which ensures a user's normal use and thus improves the user experience.

7 Claims, 3 Drawing Sheets

(56) References Cited

U.S. PATENT DOCUMENTS

| | | | |
|---|---|---|---|
| 2021/0325097 | A1 | 10/2021 | Matsuo et al. |
| 2022/0170679 | A1 | 6/2022 | Fujimoto et al. |
| 2023/0040126 | A1 | 2/2023 | Zhong |

FOREIGN PATENT DOCUMENTS

| | | | | | |
|---|---|---|---|---|---|
| CN | 103032996 | A | | 4/2013 | |
| CN | 104896647 | A | | 9/2015 | |
| CN | 108009382 | A | | 5/2018 | |
| CN | 108197407 | A | | 6/2018 | |
| CN | 109406042 | A | | 3/2019 | |
| CN | 109408963 | A | | 3/2019 | |
| CN | 110736200 | A | * | 1/2020 | ..... F25B 47/022 |
| CN | 111578472 | A | | 8/2020 | |
| CN | 112484348 | A | * | 3/2021 | ..... F24F 11/64 |
| DE | 102011119933 | A1 | | 7/2012 | |
| JP | 2003028519 | A | | 1/2003 | |
| WO | 2020115878 | A1 | | 6/2020 | |
| WO | 2020203977 | A1 | | 10/2020 | |

OTHER PUBLICATIONS

FOR1, Control Method, Control Device for Air Conditioner and Air Conditioner, 2020, Full Document (Year: 2020).*

Written Opinion of ISA received in PCT/CN2021/121837; mailed Jan. 6, 2022.

EESR received in EP Application No. 21928799.2; mailed Apr. 4, 2024.

International Search Report received in PCT/CN2021/121837; malled Jan. 6, 2022.

First OA and search report received in CN Application No. 202110233333.9; mailed Feb. 24, 2023.

Second OA received in CN Application No. 202110233333.9; mailed Jun. 8, 2023.

Rejection Decision received in CN Application No. 202110233333.9; mailed Oct. 31, 2023.

"Chemistry Principle Experiment" , p. 7-8, Dec. 31, 2019, Dang, Mingyan et al.

"Optimal Design of Food Experiments", p. 125, Mar. 31, 2018, Du, Shuangkui et al.

The Office Action received in the counterpart European Application 21928799.2, dated Feb. 24, 2026, 7 pages.

* cited by examiner

Frequency: 30 Hz

| Pe \ Power | 1500 | 2000 | 2500 | 3000 | 3500 |
|---|---|---|---|---|---|
| 0.3 | 1.107 | 1.540 | 1.979 | 2.410 | 2.821 |
| 0.4 | 1.080 | 1.506 | 1.942 | 2.375 | 2.791 |
| 0.5 | 1.082 | 1.499 | 1.930 | 2.363 | 2.783 |
| 0.6 | 1.108 | 1.514 | 1.939 | 2.370 | 2.792 |
| 0.7 | 1.154 | 1.548 | 1.964 | 2.391 | 2.814 |
| 0.8 | 1.216 | 1.595 | 2.002 | 2.422 | 2.844 |
| 0.9 | 1.289 | 1.652 | 2.046 | 2.460 | 2.878 |

CONTROL METHOD, APPARATUS, AND DEVICE FOR COMPRESSOR, STORAGE MEDIUM, AND REFRIGERATION SYSTEM

CROSS-REFERENCES TO RELATED APPLICATIONS

The present disclosure is a national phase application of International Application No. PCT/CN2021/121837, filed on Sep. 29, 2021, which claims priority to Chinese Patent Application No. 2021102333339 filed on Mar. 2, 2021, the entire disclosure of which is incorporated herein by reference.

FIELD

The present disclosure relates to the field of refrigeration technologies, and more particularly, to a control method, apparatus, and device for a compressor, a storage medium, and a refrigeration system.

BACKGROUND

Currently, in the refrigeration system, for example, in an air conditioner, data of an exhaust pressure of a compressor is required for controlling the compressor, and a physical pressure sensor is generally used to detect the exhaust pressure in practice. Once the pressure sensor malfunctions, it will take a long time to carry out maintenance, and a user cannot use the air conditioner in a case of an urgent necessity, thus user experience is poor.

SUMMARY

An object of embodiments of the present disclosure is to: provide a control method, apparatus, and device for a compressor, a storage medium, and a refrigeration system, aiming to solve the problem in the related art that since a physical pressure sensor is used to detect an exhaust pressure of a compressor, once the pressure sensor malfunctions, it will take a long time to carry out maintenance, and a user cannot use the air conditioner in a case of an urgent necessity, thus user experience is poor.

To solve the above problem, the embodiments of the present disclosure can be implemented as follows.

The embodiments of the present disclosure provide a control method for a compressor. The method includes: obtaining an electrical parameter, a return air parameter, and a first frequency of the compressor during operation of the compressor; determining a first fitting formula corresponding to the first frequency from a preset calculation model, the preset calculation model including fitting formulas corresponding to a plurality of frequencies, and each of the fitting formulas being obtained by fitting based on a historical electrical parameter, a historical return air parameter and a historical frequency of the compressor; obtaining an exhaust pressure by inputting the electrical parameter and the return air parameter into the first fitting formula for calculation; and controlling the compressor based on the exhaust pressure.

With the above implementation, the corresponding first fitting formula is determined based on the first frequency during the operation of the compressor, and the exhaust pressure is obtained by inputting the electrical parameter and the return air parameter into the first fitting formula for calculation. In this way, the pressure sensor disposed on an exhaust side of the air conditioner can be omitted, i.e., a physical pressure sensor on the exhaust side is not needed, hence cost is saved; or for the air conditioner with the pressure sensor disposed on the exhaust side, when the pressure sensor on the exhaust side is damaged, the above manner for calculation can be an alternative to obtaining the exhaust pressure, which ensures a user's normal use and thus improves the user experience.

Further, the return air parameter includes a return air pressure; and the first fitting formula includes a pressure fitting formula. The pressure fitting formula includes:

$$Pc=A_1+A_2*Pe+A_3*X+A_4*Pe^2+A_5*Pe*X+A_6*X^2;\text{ or}$$

$$Pc=A_1+A_2*Pe+A_3*X+A_4*Pe^2+A_5*Pe*X+A_6*X^2+A_7*Pe^3+A_8*Pe^2*X+A^9*Pe*X^2+A^{10}*X^3,$$

where Pc represents the exhaust pressure of the compressor, Pe represents the return air pressure of the compressor, X represents the electrical parameter of the compressor, and $A_1$ to $A_{10}$ represent coefficients of the pressure fitting formula.

With the above implementation, the exhaust pressure is obtained by using the electrical parameter, the return air pressure, the first frequency, and the above pressure fitting formula for calculation. In this way, the pressure sensor disposed on the exhaust side of the air conditioner can be omitted, i.e., the physical pressure sensor on the exhaust side is not needed, hence the cost is saved; or for the air conditioner with the pressure sensor disposed on the exhaust side, when the pressure sensor on the exhaust side is damaged, the above manner for calculation can be an alternative to obtaining the exhaust pressure, which ensures the user's normal use and thus improves the user experience.

Further, the method further includes, prior to the operation of determining the first fitting formula corresponding to the first frequency from the preset calculation model: determining whether the calculation model includes the pressure fitting formula corresponding to the first frequency; and determining, in response to determining that the calculation model includes no pressure fitting formula corresponding to the first frequency, the exhaust pressure of the compressor by means of interpolation calculation.

With the above implementation, for the case where the calculation model includes no pressure fitting formula corresponding to the first frequency, the exhaust pressure of the compressor is determined by means of the interpolation calculation, which ensures that the exhaust pressure of the compressor can be obtained at different frequencies.

Further, the operation of determining the exhaust pressure of the compressor by means of the interpolation calculation includes: obtaining a second pressure fitting formula corresponding to a second frequency and a third pressure fitting formula corresponding to a third frequency from the calculation model, the second frequency being a frequency closest to the first frequency of frequencies that correspond to the pressure fitting formulas and are greater than the first frequency, and the third frequency being a frequency closest to the first frequency of frequencies that correspond to the pressure fitting formulas and are smaller than the first frequency; obtaining a second exhaust pressure and a third exhaust pressure by substituting the obtained electrical parameter and return air pressure of the compressor into each of the second pressure fitting formula and the third pressure fitting formula; and determining the exhaust pressure of the compressor based on the second exhaust pressure and the third exhaust pressure.

Through the above manner, accuracy of the calculated value of the exhaust pressure is improved.

Further, the return air parameter includes a corresponding return air saturation temperature that is obtained based on a return air pressure during the operation of the compressor; and the first fitting formula includes a temperature fitting formula. The temperature fitting formula includes:

$$Tc=B_1+B_2*Te+B_3*X+B_4*Te^2+B_5*Te*X+B_6*X^2; \text{ or}$$

$$Tc=B_1+B_2*Te+B_3*X+B_4*Te^2+B_5*Te*X+B_6*X^2+B_7*Te^3+B_8*Te^2*X+B_9*Te*X^2+B_{10}*X^3, \text{ where}$$

Tc represents an exhaust air saturation temperature of the compressor, Tc represents the return air saturation temperature of the compressor, X represents the electrical parameter of the compressor, and $B_1$ to $B_{10}$ represent coefficients of the temperature fitting formula. The action of obtaining the exhaust pressure by inputting the electrical parameter and the return air parameter into the first fitting formula for calculation includes: obtaining the exhaust air saturation temperature by inputting the electrical parameter and the return air saturation temperature into the temperature fitting formula, and determining the exhaust pressure based on the obtained exhaust air saturation temperature.

With the above implementation, the exhaust pressure is obtained by using the electrical parameter, the return air pressure, the first frequency, and the above pressure fitting formula for calculation. In this way, the pressure sensor disposed on the exhaust side of the air conditioner can be omitted, i.e., the physical pressure sensor on the exhaust side is not needed, hence the cost is saved; or for the air conditioner with the pressure sensor disposed on the exhaust side, when the pressure sensor on the exhaust side is damaged, the above manner for calculation can be an alternative to obtaining the exhaust pressure, which ensures the user's normal use and thus improves the user experience.

Further, the method further includes, subsequent to the action of obtaining the exhaust pressure by inputting the electrical parameter and the return air parameter into the first fitting formula for calculation: obtaining a temperature of a heat exchanger in a refrigeration system where the compressor is located, and obtaining a pressure of the heat exchanger based on the temperature of the heat exchanger; obtaining pipeline pressure loss; and determining a greater one between a sum of the pressure of the heat exchanger and the pipeline pressure loss and the obtained exhaust pressure as an ultimate exhaust pressure.

Through the above manner, the obtained exhaust pressure is corrected, which improves accuracy of an ultimate calculated value of the exhaust pressure.

Further, the electrical parameter includes a power or a current.

With the above implementation, the exhaust pressure is obtained by using the power or the current for calculation, and a calculation is more precise.

The embodiments of the present disclosure further provide a control apparatus for a compressor. The apparatus includes: an obtaining module configured to obtain an electrical parameter, a return air parameter, and a first frequency of the compressor during operation of the compressor; a determining module configured to determine a first fitting formula corresponding to the first frequency from a preset calculation model, the preset calculation model including fitting formulas corresponding to a plurality of frequencies, and each of the fitting formulas being obtained by fitting based on a historical electrical parameter, a historical return air parameter, and a historical frequency of the compressor; a calculation module configured to obtain an exhaust pressure by inputting the electrical parameter and the return air parameter into the first fitting formula for calculation; and a control module configured to control the compressor based on the exhaust pressure.

With the above implementation, the corresponding first fitting formula is determined based on the first frequency of the compressor during the operation of the compressor, and the exhaust pressure is obtained by inputting the electrical parameter and the return air parameter into the first fitting formula for calculation. In this way, the pressure sensor disposed on the exhaust side of the air conditioner can be omitted, i.e., the physical pressure sensor on the exhaust side is not needed, the cost is saved; or for the air conditioner with the pressure sensor disposed on the exhaust side, when the pressure sensor on the exhaust side is damaged, the above manner for calculation can be an alternative to obtaining the exhaust pressure, which ensures the user's normal use and thus improves the user experience.

The embodiments of the present disclosure further provide a control device for a compressor. The device includes: a memory having computer-readable instructions stored thereon; a processor; and a communication bus configured to implement connection communication between the memory and the processor. The computer-readable instructions, when executed by the processor, cause the processor to perform the control method for the compressor according to any one of the above embodiments.

The embodiments of the present disclosure further provide a computer-readable storage medium. The computer-readable storage medium has a computer program stored thereon. The computer program, when executed by a processing device, performs the steps of the control method for the compressor according to any one of the above embodiments.

The embodiments of the present disclosure further provide a refrigeration system. The refrigeration system includes: a compressor; and the above described control apparatus for the compressor, or the above described control device for the compressor. The control apparatus or the control device is configured to control the compressor.

Further, the refrigeration system further includes: a pressure sensor configured to detect a return air pressure, the return air parameter including the return air pressure or a corresponding return air saturation temperature that is obtained based on the return air pressure.

The return air pressure is obtained by the pressure sensor, and the calculation of the exhaust pressure is more precise.

Further, the refrigeration system further includes: a heat exchanger; and a temperature sensor configured to detect a temperature of the heat exchanger. A pressure of the heat exchanger is obtained based on the temperature of the heat exchanger; pipeline pressure loss is obtained; and a greater one between a sum of the pressure of the heat exchanger and the pipeline pressure loss and the obtained exhaust pressure is determined as an ultimate exhaust pressure.

Through the above manner, the obtained exhaust pressure is corrected, which improves the accuracy of the ultimate calculated value of the exhaust pressure.

Further, the refrigeration system further includes an air conditioner.

In order to make the embodiments of the present disclosure more comprehensible, the following detailed description of the embodiments is described in detail below with reference to the drawings.

BRIEF DESCRIPTION OF THE DRAWINGS

In order to clearly explain embodiments of the present disclosure, drawings used in the embodiments are briefly described below. It should be understood that the drawings as described below merely illustrate some embodiments of the present disclosure, and should not be construed as limiting the scope. Based on these drawings, other drawings can be obtained.

DETAILED DESCRIPTION OF THE DISCLOSURE

The embodiments of the present disclosure will be described below with reference to the accompanying drawings in the embodiments of the present disclosure.

In the related art, since a physical pressure sensor is used to detect an exhaust pressure of a compressor, once the pressure sensor malfunctions, it will take a long time to carry out maintenance, and a user cannot use the air conditioner in a case of an urgent necessity, thus the user experience is poor. In addition, the price of the pressure sensor is relatively expensive, therefore overall cost of the air conditioner can be increased.

Figure 1:
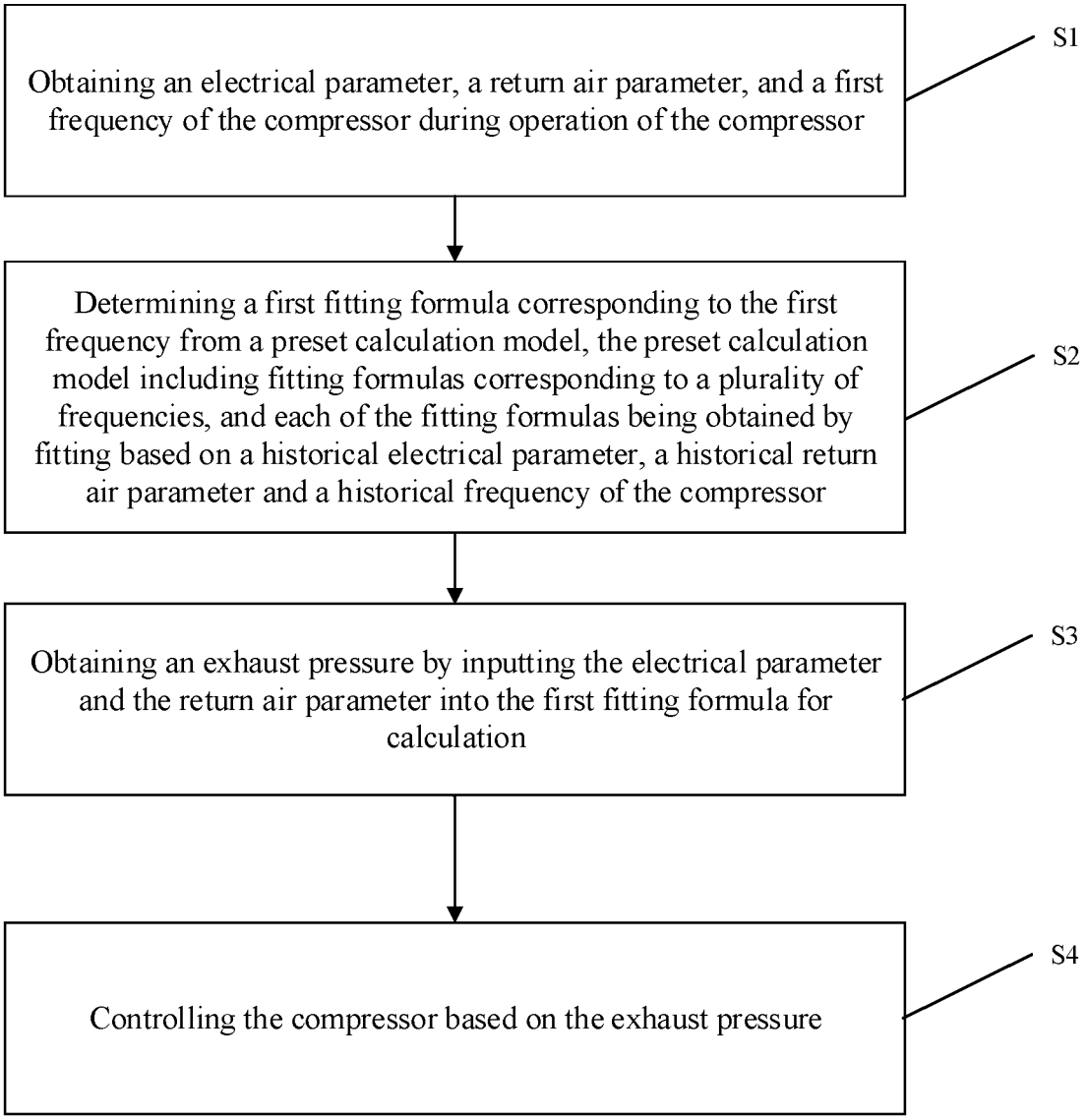
FIG. 1 is a schematic diagram of a control method for a compressor according to an embodiment of the present disclosure.

To solve the above problems, the embodiments of the present disclosure provide a control method for a compressor. Referring to FIG. 1, FIG. 1 is a schematic diagram of a control method for a compressor according to an embodiment of the present disclosure, which includes the following actions at block S1, block S2, block S3, and block S4.

The air conditioner of this embodiment may be an air conditioner having a pressure sensor for detecting an exhaust pressure when leaving a factory. The method provided by this embodiment may be an alternative solution in a case of a failure of the physical pressure sensor (i.e., the exhaust pressure is obtained by means of the method provided by this embodiment), which may be a temporary alternative, or may be a long-term replacement. The air conditioner of this embodiment may also be an air conditioner that has no physical pressure sensor for detecting the exhaust pressure when leaving the factory, and the exhaust pressure is obtained during operation of the air conditioner by means of the method provided in this embodiment.

At block S1, an electrical parameter, a return air parameter, and a first frequency of the compressor are obtained during operation of the compressor.

The electrical parameter includes a power or a current.

The return air parameter includes a return air pressure or a corresponding return air saturation temperature that is obtained based on a return air pressure during the operation of the compressor. The pressure and the saturation temperature are in one-to-one correspondence, which is an inherent property of a refrigerant. Each refrigerant has a correspondence table, which can be obtained directly by querying Rcfprop (Rcfprop is a commonly used refrigerant physical property query software). The correspondence table between the pressure and the saturation temperature can be pre-stored locally or in a cloud for subsequently querying the corresponding saturation temperature based on the pressure.

For example, a correspondence table of refrigerant R410A between the pressure of and the saturation temperature is shown in Table 1 below (it should be noted that numerical values in the embodiments of the present disclosure are merely examples for description, and do not constitute a specific limitation to the present disclosure).

TABLE 1

| Relative pressure MPa | Saturation temperature ° C. |
|---|---|
| 0.1 | −36.84 |
| 0.2 | −27.24 |
| 0.3 | −19.87 |
| 0.4 | −13.79 |
| 0.5 | −8.58 |
| 0.6 | −3.99 |
| 0.7 | 0.13 |
| 0.8 | 3.87 |
| 0.9 | 7.32 |
| 1 | 10.51 |
| 1.1 | 13.49 |
| 1.2 | 16.30 |
| 1.3 | 18.94 |
| 1.4 | 21.45 |
| 1.5 | 23.83 |
| 1.6 | 26.10 |
| 1.7 | 28.28 |
| 1.8 | 30.37 |
| 1.9 | 32.37 |
| 2 | 34.30 |
| 2.1 | 36.16 |
| 2.2 | 37.96 |
| 2.3 | 39.70 |
| 2.4 | 41.39 |
| 2.5 | 43.03 |
| 2.6 | 44.61 |
| 2.7 | 46.16 |
| 2.8 | 47.66 |
| 2.9 | 49.12 |
| 3 | 50.54 |

Air enters the compressor from a return air port and is discharged from an exhaust port. The power and the current may be calculated or collected by a driving chip of the compressor. The return air pressure may be detected by the pressure sensor disposed on a return air side of the compressor, and the first frequency may be collected by the driving chip of the compressor.

At block S2, a first fitting formula corresponding to the first frequency is determined from a preset calculation model. The preset calculation model includes fitting formulas corresponding to a plurality of frequencies, and each of the fitting formulas is obtained by fitting based on a historical electrical parameter, a historical return air parameter and a historical frequency of the compressor.

At block S3, an exhaust pressure is obtained by inputting the electrical parameter and the return air parameter into the first fitting formula for calculation.

In this embodiment, the calculation model is obtained in the following manners: the historical electrical parameter, the historical return air parameter, and the historical frequency of the compressor are obtained in advance; fitting is performed; and classification is performed based on different frequencies, each different frequency having a fitting formula corresponding thereto, i.e., different frequencies corresponding to different pressure fitting formulas. For example, frequency 1 corresponds to fitting formula 1, and frequency 2 corresponds to fitting formula 2. After the electrical parameter, the return air parameter and the first frequency of the compressor during the operation of the compressor are obtained in the action at block S1, the corresponding first fitting formula is determined based on the first frequency, and the exhaust pressure is obtained by inputting the electrical parameter and the return air parameter into the first fitting formula for calculation.

In this embodiment, the exhaust pressure may also be obtained in advance based on the calculation model; and then the correspondence table between the electrical parameter, the return air parameter, the frequency, and the exhaust pressure is stored; and when the electrical parameter, the return air parameter, the first frequency of the compressor during the operation of the compressor are obtained in the action at block S1, the exhaust pressure is obtained directly by querying the stored correspondence table between the electrical parameter, the return air parameter, the frequency, and the exhaust pressure.

The corresponding first fitting formula is determined based on the first frequency during the operation of the compressor, and the exhaust pressure is obtained by inputting the electrical parameter and the return air parameter during the operation of the processor into the first fitting formula for calculation. In this way, the pressure sensor disposed on the exhaust side of the air conditioner can be omitted, i.e., the physical pressure sensor on the exhaust side is not needed, cost is saved; or for the air conditioner with the pressure sensor disposed on the exhaust side, when the pressure sensor on the exhaust side is damaged, the above manner for calculation can be an alternative to obtaining the exhaust pressure, which ensures the user's normal use and thus improves the user experience.

In this embodiment, the exhaust pressure may be obtained in advance based on the calculation model, and then the correspondence table between the electrical parameter, the return air parameter, the frequency and the exhaust pressure is stored, and when the first frequency, the electrical parameter and the return air parameter during the operation of the compressor are obtained in the action at block S1, the exhaust pressure is directly obtained by querying the table. After the first frequency, the electrical parameter, and the return air parameter during the operation of the compressor are obtained in the action at block S1, whether there is the corresponding exhaust pressure can be determined by querying the table, and if no exhaust pressure corresponding to the first frequency is stored in the correspondence table, the action at block S2 is performed.

A case where the return air parameter is the return air pressure and the first fitting formula is the pressure fitting formula will be described below.

In this embodiment, the return air parameter includes a return air pressure; and the first fitting formula includes a pressure fitting formula. The pressure fitting formula includes:

$$Pc=A_1+A_2*Pe+A_3*X+A_4*Pe^2+A_5*Pe*X+A_6*X^2,$$

this formula being in a form of six coefficients; or $$Pc=A_1+A_2*Pe+A_3*X+A_4*Pe^2+A_5*Pe*X+A_6*X^2+A_7*Pe^3+A_8*Pe^2*X+A_9*Pe*X^2+A_{10}*X^3,$$

this formula being in a form of ten coefficients, where Pc represents the exhaust pressure of the compressor, Pe represents the return air pressure of the compressor, X represents the electrical parameter of the compressor, and $A_1$ to $A_{10}$ represent coefficients of the pressure fitting formula.

Each different frequency has a pressure fitting formula corresponding thereto, i.e., different frequencies correspond to different pressure fitting formulas. Different frequencies herein corresponding to different pressure fitting formulas refers to values of the ten coefficients $A_1$ to $A_{10}$ in the pressure fitting formulas corresponding to different frequencies being different. The frequency is used for frequency segmentation. For a compressor, ten coefficients for different frequencies are different. The finer the segmentation, the more accurate the calculation. The coefficient is fixed for a frequency of a compressor, and is obtained by fitting based on a massive amount of historical experimental data of the compressor.

In this embodiment, the electrical parameter includes a power or a current.

A case where the return air parameter is the return air pressure, the first fitting formula is the pressure fitting formula, and the electrical parameter is the power will be described below.

In an implementation, when the electrical parameter is a power W, i.e., X is the power W of the compressor, the pressure fitting formula includes:

$$Pc=A_1+A_2*Pe+A_3*W+A_4*Pe^2+A_5*Pe*W+A_6*W^2; \text{ or}$$

$$Pc=A_1+A_2*Pe+A_3*W+A_4*Pe^2+A_5*Pe*W+A_6*W_2+A_7*Pe^3+A_8*Pe^2*W+A_9*Pe*W^2+A_{10}*W^3.$$

The above pressure fitting formula is obtained by fitting based on a historical power, a historical return air pressure and the historical frequency of the compressor. Each different frequency has a pressure fitting formula corresponding thereto, i.e., different frequencies correspond to different pressure fitting formulas. Different frequencies herein corresponding to different pressure fitting formulas refers to the coefficients in the pressure fitting formulas are different, i.e., values of the ten coefficients $A_1$ to $A_{10}$ are different.

For example, ten coefficients for a compressor at a frequency of 30 Hz are shown in Table 2 below (the power W and the return air pressure Pe are inputted for calculation):

TABLE 2

| | |
|---|---|
| $A_1$ | 0.166525 |
| $A_2$ | −1.33653 |
| $A_3$ | 0.000724 |
| $A_4$ | 2.590484 |
| $A_5$ | −0.00032 |
| $A_6$ | 0.000000094 |
| $A_7$ | −0.73553 |
| $A_8$ | −0.00018 |
| $A_9$ | 0.0000000861 |
| $A_{10}$ | −0.000000000018 |

Ten coefficients for a compressor at a frequency of 60 Hz are shown in Table 3 below (the power W and the return air pressure Pe are inputted for calculation):

TABLE 3

| | |
|---|---|
| $A_1$ | 0.180344 |
| $A_2$ | −1.34257 |
| $A_3$ | 0.000364 |
| $A_4$ | 2.58706 |
| $A_5$ | −0.00016 |
| $A_6$ | 0.0000000232 |
| $A_7$ | −0.73553 |
| $A_8$ | −0.00009 |
| $A_9$ | 0.0000000215 |
| $A_{10}$ | −0.0000000000022 |

Figures 2, 3:
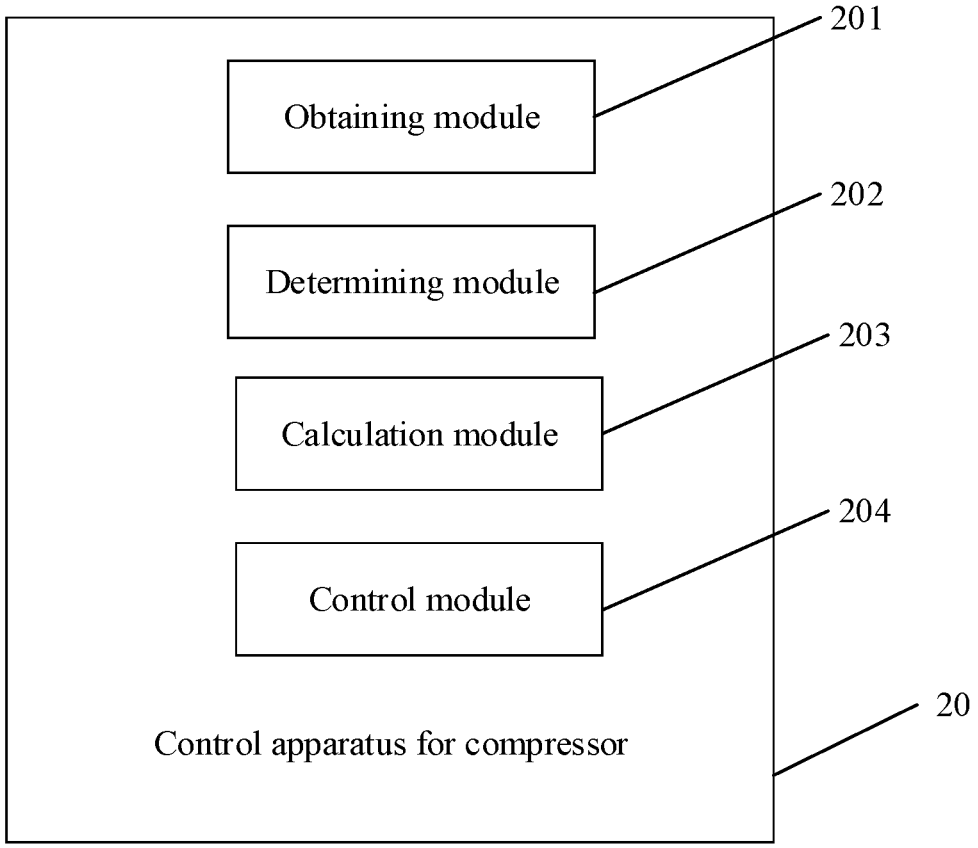
FIG. 2 is a schematic diagram of a correspondence table of a power, a return air pressure, and an exhaust pressure at a frequency of 30 Hz according to an embodiment of the present disclosure.
FIG. 3 is a schematic diagram of a control apparatus for a compressor according to an embodiment of the present disclosure.

In this embodiment, the exhaust pressure may be obtained in advance based on the calculation model, and then the correspondence table between the frequency, the power, the return air pressure, and the exhaust pressure is stored, and when the first frequency, the power, and the return air pressure during the operation of the compressor are obtained in the action at block S1, the exhaust pressure is obtained by querying the table directly. For example, the correspondence of the frequency of 30 Hz is shown in FIG. 2. As shown in FIG. 2, when a current frequency is 30 Hz, a current power is 3000 W, and a current return air pressure is 0.7, an exhaust pressure by querying the table is 2.391 MPa.

A case where the return air parameter is the return gas pressure, the first fitting formula is the pressure fitting formula, and the electrical parameter is the current will be described below.

In an implementation, when the electrical parameter is a current I, i.e., when X is the current I of the compressor, the pressure fitting formula includes:

$$Pc=A_1+A_2*Pe+A_3*I+A_4*Pe^2+A_5*Pe*I+A_6*I^2;\text{ or}$$

$$Pc=A_1+A_2*Pe+A_3*I+A_4*Pe^2+A_5*Pe*I+A_6*I^2+A_7*Pe^3+A_8*Pe^2*I+A_9*Pe*I^2+A_{10}*I^3.$$

For example, ten coefficients of a compressor at a frequency of 30 Hz are shown in Table 4 below (the current I and the return air pressure Pe are inputted for calculation):

TABLE 4

| | |
|---|---|
| $A_1$ | 0.166525 |
| $A_2$ | −1.33653 |
| $A_3$ | 0.159364 |
| $A_4$ | 2.590484 |
| $A_5$ | −0.07013 |
| $A_6$ | 0.00455 |
| $A_7$ | −0.73553 |
| $A_8$ | −0.03958 |
| $A_9$ | 0.004167 |
| $A_{10}$ | −0.00019 |

A case where the calculation model includes no pressure fitting formula corresponding to the first frequency will be described below.

In this embodiment, the method further includes, prior to the operation at S2 of determining the first fitting formula corresponding to the first frequency from the preset calculation model: determining whether the calculation model includes the pressure fitting formula corresponding to the first frequency; and determining, in response to determining that the calculation model includes no pressure fitting formula corresponding to the first frequency, the exhaust pressure of the compressor by means of interpolation calculation.

With the above implementation, for the case where the calculation model includes no pressure fitting formula corresponding to the first frequency, i.e., the first frequency has no corresponding pressure fitting formula, the exhaust pressure of the compressor is determined by means of interpolation calculation, which ensures the exhaust pressure of the compressor can be obtained at different frequencies.

In this embodiment, the action of determining the exhaust pressure of the compressor by means of the interpolation calculation (interpolation solution refers to linear interpolation calculation for each different frequency using an upper and lower limit frequency corresponding the frequency) may be implemented in the following manners: obtaining a second pressure fitting formula corresponding to a second frequency and a third pressure fitting formula corresponding to a third frequency from the calculation model (i.e. two existing frequencies and the corresponding pressure fitting formulas are obtained in advance from the calculation model), the second frequency being a frequency closest to the first frequency of frequencies that correspond to the pressure fitting formulas and are greater than the first frequency, and the third frequency being a frequency closest to the first frequency of frequencies that correspond to the pressure fitting formulas and are smaller than the first frequency (with this kind of frequency selection, the accuracy of the exhaust pressure by means of interpolation calculation can be improved); obtaining a second exhaust pressure and a third exhaust pressure by substituting the obtained electrical parameter and return air pressure of the compressor into each of the second pressure fitting formula and the third pressure fitting formula; and determining the exhaust pressure of the compressor based on the second exhaust pressure and the third exhaust pressure.

For example, ten coefficients for frequency point of 30 Hz and ten coefficients for frequency point of 60 Hz are given to solve an exhaust pressure for 45 Hz. As long as the exhaust pressure for 30 Hz and the exhaust pressure for 60 Hz are obtained first, an exhaust pressure for 45 Hz can be obtained by means of the interpolation. In some embodiments, an exhaust pressure for 45 Hz can be obtained by means of linear interpolation between the exhaust pressure for 30 Hz and the exhaust pressure for 60 Hz.

Through the above manner, the accuracy of the calculated value of the exhaust pressure is improved.

A case where the return air parameter is a corresponding return air saturation temperature that is obtained based on a return air pressure during the operation of the compressor, and the first fitting formula is a temperature fitting formula will be described below.

In this embodiment, the return air parameter includes a corresponding return air saturation temperature that is obtained based on a return air pressure during the operation of the compressor; and the first fitting formula includes a temperature fitting formula. The temperature fitting formula includes:

$$Tc=B_1+B_2*Te+B_3*X+B_4*Te^2+B_5*Te*X+B_6*X^2;\text{ or}$$

$$Tc=B_1+B_2*Te+B_3*X+B_4*Te^2+B_5*Te*X+B_6*X^2+B_7*Te^3+B_8*Te^2*X+B_9*Te*X^2+B_{10}*X^3,$$

where Tc represents an exhaust air saturation temperature of the compressor, Tc represents the return air saturation temperature of the compressor, X represents the electrical parameter of the compressor, and $B_1$ to $B_{10}$ represent coefficients of the temperature fitting formula.

Each different frequency has a temperature fitting formula corresponding thereto, i.e., different frequencies correspond to different temperature fitting formulas. Different frequencies herein corresponding to different temperature fitting formulas refers to the coefficients in the temperature fitting formulas corresponding to different frequencies are different, i.e., values of the ten coefficients $B_1$ to $B_{10}$ are different. The coefficient is fixed for a frequency of a compressor, and is obtained by fitting based on a massive amount of the historical experimental data of the compressor.

The action of obtaining the exhaust pressure by inputting the electrical parameter and the return air parameter into the first fitting formula for calculation includes: obtaining the exhaust air saturation temperature by inputting the electrical parameter and the return air saturation temperature into the temperature fitting formula, and determining the exhaust pressure based on the obtained exhaust air saturation temperature. When the exhaust pressure is determined based on the exhaust air saturation temperature, it has been described above that the pressure and the saturation temperature are in one-to-one correspondence, which is the inherent property of the refrigerant. Each refrigerant has the correspondence table, which can be directly obtained by querying Rcfprop. The correspondence table between the pressure and the saturation temperature can be pre-stored locally or in the cloud for subsequently querying the corresponding saturation temperature based on the pressure.

A case where the return air parameter is a corresponding return air saturation temperature that is obtained based on a return air pressure during the operation of the compressor, the first fitting formula is a temperature fitting formula, and the electrical parameter is the power will be described below.

In an implementation, when the electrical parameter is the power W, i.e., the X is the power W of the compressor, the temperature fitting formula includes:

$$Tc=B_1+B_2*Te+B_3*W+Be_4*Te_2+B_5*Te*W+B_6*W^2;\text{ or}$$

$$Tc=B_1+B_2*Te+B_3*W+Be_4*Te_2+B_5*Te*W+B_6*W^2+B_7*Te^3+B_8*Te_2*W+B_9*Te*W^2+B_{10}*W^3.$$

The above temperature fitting formula is obtained by fitting based on the historical power, the historical return air saturation temperature, and the historical frequency of the compressor. Each different frequency has a temperature fitting formula corresponding thereto, i.e., different frequencies correspond to different temperature fitting formulas. Different frequencies herein corresponding to different temperature fitting formulas refers to the coefficients in the temperature fitting formulas are different, i.e., values of the ten coefficients $B_1$ to $B_{10}$ are different.

For example, ten coefficients for a compressor at a frequency of 30 Hz are shown in Table 5 below (the power W and the return air saturation temperature Te are inputted for calculation):

TABLE 5

| | |
|---|---|
| $B_1$ | 0.412209 |
| $B_2$ | 0.037819 |
| $B_3$ | 0.000333 |
| $B_4$ | 0.00061 |
| $B_5$ | −0.000016 |
| $B_6$ | 0.000000167 |
| $B_7$ | −0.000011 |
| $B_8$ | −0.00000013 |
| $B_9$ | 0.00000000221 |
| $B_{10}$ | −0.000000000018 |

A case where the return air parameter is a corresponding return air saturation temperature that is obtained based on a return air pressure during the operation of the compressor, the first fitting formula is a temperature fitting formula, and the electrical parameter is the power will be described below.

In an implementation, when the electrical parameter is the current I, i.e., the X is the current I of the compressor, the temperature fitting formula includes:

$$Tc=B_1+B_2*Te+B_3*I+B_4*Te^2+B_5*Te*I+B_6*I^2;\text{ or}$$

$$Tc=B_1+B_2*Te+B_3*I+B_4*Te^2+B_5*Te*I+B_6*I^2+B_7*Te^3+B_8*Te^2*I+B_9*Te*I^2+B_{10}*I^3.$$

Examples thereof will not be described herein.

In this embodiment, the exhaust pressure obtained in the action at block S3 can be corrected by using a temperature of a heat exchanger in the refrigeration system where the compressor is located, ensuring the accuracy in some situations. The case where the exhaust pressure obtained in the action at block S3 is corrected by using the temperature of the heat exchanger will be described below.

In this embodiment, at block S3, the method further includes, subsequent to the action of obtaining the exhaust pressure by inputting the electrical parameter and the return air parameter into the first fitting formula for calculation: obtaining a temperature Thx of a heat exchanger in a refrigeration system where the compressor is located is obtained, and obtaining a pressure P_cond of the heat exchanger based on the temperature Thx of the heat exchanger; obtaining pipeline pressure loss ΔP; and determining a greater one between a sum (i.e., P_cond+ΔP) of the pressure of the heat exchanger and the pipeline pressure loss and the obtained exhaust pressure as an ultimate exhaust pressure.

The temperature Thx of the heat exchanger is converted into the pressure P_cond of the heat exchanger by the linear fitting calculation formula or interpolation solution of the parameter table based on the physical property of the refrigerant. The temperature of the refrigerant is regarded as a saturated gaseous state, and the corresponding saturation pressure can be obtained by querying the table directly. It has been described above that the pressure and the saturation temperature are in one-to-one correspondence, which is the inherent property of the refrigerant. Each refrigerant has the correspondence table, which can be obtained by querying the Rcfprop directly. The correspondence table between the pressure and the saturation temperature can be pre-stored locally or in the cloud in this embodiment.

The pipeline pressure loss ΔP is complex to be specifically calculated with great precision, but indeed can be roughly calculated based on the frequency, and a specific relational expression thereof is determined based on each system. For example, the pipeline pressure loss ΔP is the coefficient multiplied by the compressor frequency, and the coefficient is manually set and may be 0.0007. The embodiments of the present disclosure have no specific limitation on the coefficient, and the coefficient may also be other values.

Generally, the exhaust pressure obtained in the action at block S3 is basically equal to the actual exhaust pressure, but there is a situation where the calculated value is lower than the actual exhaust pressure. In this case, the use of P_Cond+ΔP for calculation is more accurate.

At block S4, the compressor is controlled based on the exhaust pressure.

With the implementation of this embodiment, the corresponding first fitting formula is determined based on the first frequency during the operation of the compressor, and the exhaust pressure is obtained by inputting the electrical parameter and the return air parameter during the operation of the compressor into the first fitting formula for calculation. In this way, the pressure sensor disposed on the exhaust side of the air conditioner can be omitted, i.e., the physical pressure sensor on the exhaust side is not needed, hence the cost is saved; or for the air conditioner with the pressure sensor disposed on the exhaust side, when the pressure sensor on the exhaust side is damaged, the above manner for calculation can be an alternative to obtaining the exhaust pressure, which ensures the user's normal use and thus improves the user experience.

Embodiment II

An embodiment of the present disclosure provides a control apparatus 20 for a compressor. Referring to FIG. 3, FIG. 3 illustrates the control apparatus 20 for the compressor using the method illustrated in FIG. 1. It should be understood that the specific function of the control apparatus 20 for the compressor may refer to the description above, and details thereof is omitted herein to avoid repetition. The control apparatus 20 for the compressor includes at least one software function module that can be stored in a memory in a form of software or firmware or consolidate in an operating system of the control apparatus 20 for the compressor.

FIG. 3 is a schematic diagram of a control apparatus for a compressor according to an embodiment of the present disclosure. The apparatus includes: an obtaining device 201 configured to obtain an electrical parameter, a return air parameter, and a first frequency of the compressor during operation of the compressor; a determining device 202 configured to determine a first fitting formula corresponding to the first frequency from a preset calculation model, the preset calculation model including fitting formulas corresponding to a plurality of frequencies, and each of the fitting formulas being obtained by fitting based on a historical electrical parameter, a historical return air parameter, and a historical frequency of the compressor; a calculation device 203 configured to obtain an exhaust pressure by inputting the electrical parameter and the return air parameter into the first fitting formula for calculation; and a control device 204 configured to control the compressor based on the exhaust pressure.

With the implementation of this embodiment, the corresponding first fitting formula is determined based on the first frequency of the compressor during the operation of the compressor, and the exhaust pressure is obtained by inputting the electrical parameter and the return air parameter of the compressor during the operation of the compressor into the first fitting formula for calculation. In this way, the pressure sensor disposed on the exhaust side of the air conditioner can be omitted, i.e., the physical pressure sensor on the exhaust side is not needed, hence the cost is saved; or for the air conditioner with the pressure sensor disposed on the exhaust side, when the pressure sensor on the exhaust side is damaged, the above manner for calculation can be an alternative to obtaining the exhaust pressure, which ensures the user's normal use and thus improves the user experience.

In an embodiment, the return air parameter includes a return air pressure; and the first fitting formula includes a pressure fitting formula. The pressure fitting formula includes:

$$Pc=A_1+A_2*Pe+A_3*X+A_4*Pe^2+A_5*Pe*X+A_6*X^2;\text{ or}$$

$$Pc=A_1+A_2*Pe+A_3*X+A_4*Pe^2+A_5*Pe*X+A_6*X^2+A_7*Pe^3+A_8*Pe^2*X+A_9*Pe*X^2+A_{10}*X^3,$$

where Pc represents the exhaust pressure of the compressor, Pe represents the return air pressure of the compressor, X represents the electrical parameter of the compressor, and $A_1$ to $A_{10}$ represent coefficients of the pressure fitting formula.

In an embodiment, the apparatus is further configured to: determine whether the calculation model includes the pressure fitting formula corresponding to the first frequency; and determine, in response to determining that the calculation model includes no pressure fitting formula corresponding to the first frequency, the exhaust pressure of the compressor by means of interpolation calculation.

In an embodiment, the apparatus is further configured to: obtain a second pressure fitting formula corresponding to a second frequency and a third pressure fitting formula corresponding to a third frequency from the calculation model, the second frequency being a frequency closest to the first frequency of frequencies that correspond to the pressure fitting formulas and are greater than the first frequency, and the third frequency being a frequency closest to the first frequency of frequencies that correspond to the pressure fitting formulas and are smaller than the first frequency; obtain a second exhaust pressure and a third exhaust pressure by substituting the obtained electrical parameter and return air pressure of the compressor into each of the second pressure fitting formula and the third pressure fitting formula; and determine the exhaust pressure of the compressor based on the second exhaust pressure and the third exhaust pressure.

In an embodiment, the return air parameter includes a corresponding return air saturation temperature that is obtained based on a return air pressure during the operation of the compressor; and the first fitting formula includes a temperature fitting formula. The temperature fitting formula includes:

$$Tc=B_1+B_2*Te+B_3*X+B_4*Te^2+B_5*Te*X+B_6*X^2;\text{ or}$$

$$Tc=B_1+B_2*Te+B_3*X+B_4*Te^2+B_5*Te*X+B_6*X^2+B_7*Te^3+B_8*Te^2*X+B_9*Te*X^2+B_{10}*X^3,$$

where Tc represents an exhaust air saturation temperature of the compressor, Tc represents the return air saturation temperature of the compressor, X represents the electrical parameter of the compressor, and $B_1$ to $B_{10}$ represent coefficients of the temperature fitting formula. The calculation device 203 is further configured to: obtain the exhaust air saturation temperature by inputting the electrical parameter and the return air saturation temperature into the temperature fitting formula, and determine the exhaust pressure based on the obtained exhaust air saturation temperature.

In an embodiment, the apparatus is further configured to: obtain a temperature of a heat exchanger in a refrigeration system where the compressor is located, and obtain a pressure of the heat exchanger based on the temperature of the heat exchanger; obtain pipeline pressure loss; and determine a greater one between a sum of the pressure of the heat exchanger and the pipeline pressure loss and the obtained exhaust pressure as an ultimate exhaust pressure.

In an embodiment, the electrical parameter includes a power or a current.

It should be understood that, for the sake of a concise description, some of the content described in the first embodiment will not be repeated in this embodiment.

Embodiment III

Figure 4:
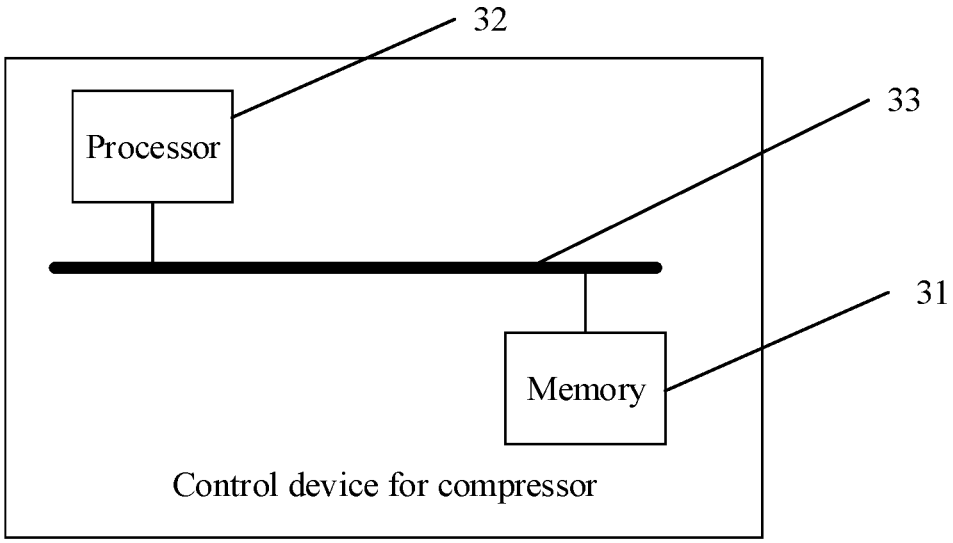
FIG. 4 is a schematic diagram of a control device for a compressor according to an embodiment of the present disclosure.

This embodiment of the present disclosure provides a control device for a compressor. Referring to FIG. 4, FIG. 4 is a schematic diagram of a control device for a compressor according to this embodiment. The device includes a memory 31 having computer-readable instructions stored thereon; a processor 32; and a communication bus 33 configured to implement connection communication between the memory 31 and the processor 32. The computer-readable instructions, when executed by the processor 32, cause the processor 32 to perform the control method for the compressor according to the first embodiment, and details thereof are not repeated herein.

It can be understood that the structure illustrated in FIG. 4 is merely exemplary, and the control device for the compressor may further include more or fewer components than those illustrated in FIG. 4, or have different configurations as illustrated in FIG. 4.

Embodiment IV

This embodiment of the present disclosure provides a non-volatile readable storage medium, e.g., a floppy disk, an optical disk, a hard disk, a flash memory, a USB flash disk, a Secure Digital Memory Card (SD), a Multimedia Card (MMC). The non-volatile readable storage medium has computer readable instructions stored thereon. The computer readable instructions, when executed by the processor, cause the processor to perform the control method for the compressor according to the first embodiment, and details thereof are not repeated herein.

Embodiment V

This embodiment of the present disclosure provides a refrigeration system. The system includes: a compressor; the control apparatus for the compressor according to the second embodiment, or the control device for the compressor according to the third embodiment. The control apparatus or the control device is configured to control the compressor.

In an embodiment, in this embodiment, the refrigeration system further includes: a pressure sensor configured to detect a return air pressure. The return air parameter includes the return air pressure or a corresponding return air saturation temperature that is obtained based on the return air pressure.

The return air pressure is obtained by the pressure sensor, and the calculation of the exhaust pressure is more accurate.

In an embodiment, the refrigeration system further includes a heat exchanger; and a temperature sensor configured to detect a temperature Thx of the heat exchanger. A pressure P_cond of the heat exchanger is obtained based on the temperature Thx of the heat exchanger; pipeline pressure loss is obtained; and a greater one between a sum (i.e., P_cond+ΔP) of the pressure of the heat exchanger and the pipeline pressure loss and the obtained exhaust pressure is determined as an ultimate exhaust pressure.

Through the above manner, the obtained exhaust pressure is corrected, which improves the accuracy of the ultimate calculated value of the exhaust pressure.

In this embodiment, the refrigeration system includes an air conditioner.

In the embodiments provided by the present disclosure, it should be understood that, the disclosed module and method may be implemented in other ways. The module embodiments described above are merely illustrative, for example, are merely divided according to logical functions, and can be divided in other ways in actual implementation. For example, a plurality of modules or components may be combined or may be integrated into another terminal, or some features may be omitted. For example, respective functional modules in respective embodiments of the present disclosure may be integrated to form an independent part, or the respective modules may be separate existence, or two or more modules may be integrated to form an independent part.

In addition, the mutual coupling or direct coupling or communication connection illustrated or discussed may be via some communication interfaces, or indirect coupling or communication connection of modules or units, which may be in an electrical, mechanical, or other form.

In this disclosure, the relational terms herein, such as "first" and "second", are used only for differentiating one entity or operation, from another entity or operation, without necessarily requiring or implying that there should be any actual relationship or sequence among the entities or operations.

While the embodiments of the present disclosure have been described above, they are not intended to limit the present disclosure. Various changes and variations can be made to the present disclosure. Any modifications, equivalent replacement, and improvements made within the spirit and principle of the present disclosure are to be encompassed by the scope of the claims of the present disclosure.

INDUSTRIAL APPLICABILITY

In the control method, apparatus, and device for the compressor, the storage medium, and the refrigeration system provided in the embodiments of the present disclosure, the exhaust pressure can be obtained based on the calculation of the electrical parameter, the return air parameter, and the first frequency of the compressor during the operation of the compressor. In this way, the pressure sensor disposed on the exhaust side of the air conditioner can be omitted, hence the cost is saved; or for the air conditioner with the pressure sensor disposed on the exhaust side, when the pressure sensor on the exhaust side is damaged, the user can still use the air conditioner normally, thus the user experience is improved.

What is claimed is:

1. A control method for a compressor, comprising:

obtaining an electrical parameter, a return air parameter, and a first frequency of the compressor during operation of the compressor;

determining a first fitting formula corresponding to the first frequency from a preset calculation model, wherein the preset calculation model comprises fitting formulas corresponding to a plurality of frequencies, and wherein each of the fitting formulas is obtained by fitting based on a historical electrical parameter, a historical return air parameter and a historical frequency of the compressor;

obtaining an exhaust pressure by inputting the electrical parameter and the return air parameter into the first fitting formula for calculation;

obtaining a temperature of a heat exchanger in a refrigeration system where the compressor is located, and obtaining a pressure of the heat exchanger based on the temperature of the heat exchanger;

obtaining pipeline pressure loss;

determining a greater one between a sum of the pressure of the heat exchanger and the pipeline pressure loss and the obtained exhaust pressure as an ultimate exhaust pressure; and controlling the compressor based on the exhaust pressure.

2. The method according to claim 1, wherein:

the return air parameter comprises a return air pressure; and the first fitting formula comprises a pressure fitting formula, the pressure fitting formula comprising:

$$Pc=A1+A_2*Pe+A_3*X+A_4*Pe^2+A_5*Pe*X+A_6*X^2;\text{ or}$$

$$Pc=A_1+A_2*Pe+A_3*X+A_4*Pe^2+A_5*Pe*X+A_6*X^2+A_7*Pe^3+A_8*Pe^2*X+A_9*Pe*X^2+A_{10}*X^3,$$

where Pc represents the exhaust pressure of the compressor, Pe represents the return air pressure of the compressor, X represents the electrical parameter of the compressor, and $A_1$ to $A_{10}$ represent coefficients of the pressure fitting formula.

3. The method according to claim 2, further comprising, prior to the operation of determining the first fitting formula corresponding to the first frequency from the preset calculation model:

determining whether the preset calculation model comprises the pressure fitting formula corresponding to the first frequency; and determining, in response to determining that the preset calculation model comprises no pressure fitting formula corresponding to the first frequency, the exhaust pressure of the compressor by means of interpolation calculation.

4. The method according to claim 3, wherein said determining the exhaust pressure of the compressor by means of the interpolation calculation comprises:

obtaining a second pressure fitting formula corresponding to a second frequency and a third pressure fitting formula corresponding to a third frequency from the preset calculation model, the second frequency being a frequency closest to the first frequency of frequencies that correspond to pressure fitting formulas and are greater than the first frequency, and the third frequency being a frequency closest to the first frequency of frequencies that correspond to the pressure fitting formulas and are smaller than the first frequency;

obtaining a second exhaust pressure and a third exhaust pressure by substituting the obtained electrical parameter and return air pressure of the compressor into each of the second pressure fitting formula and the third pressure fitting formula; and determining the exhaust pressure of the compressor based on the second exhaust pressure and the third exhaust pressure.

5. The method according to claim 1, wherein:

the return air parameter comprises a corresponding return air saturation temperature that is obtained based on a return air pressure during the operation of the compressor; and the first fitting formula comprises a temperature fitting formula, the temperature fitting formula comprising:

$$Tc=B_1+B_2*Te+B_3*X+B_4*Te^2+B_5*Te*X+B_6*X^2;\text{ or}$$

$$Tc=B_1+B_2*Te+B_3*X+B_4*Te^2+B_5*Te*X+B_6*X^2+B_7*Te^3+B_8*Te^2*X+B_9*Te*X^2+B_{10}*X^3,$$

where Tc represents an exhaust air saturation temperature of the compressor, Tc represents the return air saturation temperature of the compressor, X represents the electrical parameter of the compressor, and $B_1$ to $B_{10}$ represent coefficients of the temperature fitting formula; and said obtaining the exhaust pressure by inputting the electrical parameter and the return air parameter into the first fitting formula for calculation comprises: obtaining the exhaust air saturation temperature by inputting the electrical parameter and the return air saturation temperature into the temperature fitting formula, and determining the exhaust pressure based on the obtained exhaust air saturation temperature.

6. The method according to claim 5, wherein said determining the exhaust pressure based on the obtained exhaust air saturation temperature comprises:

determining an exhaust pressure corresponding to the obtained exhaust air saturation temperature based on a pre-stored correspondence table between the pressure and the saturation temperature.

7. The method according to claim 1, wherein the electrical parameter comprises a power or a current.

* * * * *